US007664278B2

(12) United States Patent
Watanabe et al.

(10) Patent No.: US 7,664,278 B2
(45) Date of Patent: Feb. 16, 2010

(54) ACOUSTIC DEVICE AND FLAT SPEAKER THEREOF

(75) Inventors: Keita Watanabe, Fujiyoshida (JP); Kazuhiro Kobayashi, Fujiyoshida (JP)

(73) Assignee: Citizen Electronics Co., Ltd., Fujiyoshida-shi, Yamanashi-ken (JP)

( * ) Notice: Subject to any disclaimer, the term of this patent is extended or adjusted under 35 U.S.C. 154(b) by 772 days.

(21) Appl. No.: 11/304,513

(22) Filed: Dec. 14, 2005

(65) Prior Publication Data

US 2006/0140437 A1 Jun. 29, 2006

(30) Foreign Application Priority Data

Dec. 15, 2004 (JP) ..... 2004-362671

(51) Int. Cl.
*H04R 25/00* (2006.01)

(52) U.S. Cl. ..... 381/152; 381/431

(58) Field of Classification Search ..... 381/152, 381/306, 332, 333, 337, 353, 354, 184, 386, 381/388, 398, 423, 424, 431; 361/679.23, 361/679.26, 679.55
See application file for complete search history.

(56) References Cited

U.S. PATENT DOCUMENTS 7,120,264 B2 * 10/2006 Saiki et al. ..... 381/184
2001/0026625 A1 * 10/2001 Azima et al. ..... 381/152
2007/0206822 A1 * 9/2007 Whitwell et al. ..... 381/152

FOREIGN PATENT DOCUMENTS

JP 2004-336403 11/2004
WO WO 00/02417 1/2000

* cited by examiner

*Primary Examiner*—Huyen D Le
(74) *Attorney, Agent, or Firm*—Brinks Hofer Gilson & Lione

(57) ABSTRACT

A flat speaker includes a casing with a display window, a vibratory sound panel mounted to the display window and having a display region and an exciter mount region, a display screen disposed internally of the display region, and an exciter mounted to the inner surface of the exciter mount region. A dust barrier is disposed to isolate a first space defined between the display region and the display screen from a second space surrounding the first space. The dust barrier has a dust barrier member disposed between the display region and the exciter mount region and extending across the vibratory sound panel to inhibit dust particles from moving from said exciter mount region to said display region within said casing. The dust barrier member is yieldingly deformable in response to vibration of said vibratory sound panel.

16 Claims, 9 Drawing Sheets

ACOUSTIC DEVICE AND FLAT SPEAKER THEREOF

This application claims priority under 35 U.S.C. § 119 to Japanese Patent Application No. 2004-362671 filed Dec. 15, 2004, the entire content of which is hereby incorporated by reference.

FIELD OF THE INVENTION

The present invention relates to an acoustic device such as a cell phone, a personal computer, a television set and other acoustic devices having a display and a flat speaker installed in the acoustic device.

BACKGROUND OF THE INVENTION

A conventional flat speaker includes a transparent vibratory sound panel mounted to the window frame of the casing of an acoustic device having a display assembly and adapted to protect a display screen such as a liquid crystal display, a suspension by which the sound panel is supported on the window frame, and an exciter secured to the inner surface of the sound panel at a position separately from the display screen and adapted to cause the vibratory sound panel to vibrate in response to an electric signal (see, for example, Japanese patent disclosure No. 2002-533957). Reference will first be made to FIGS. 14 to 16 wherein one example of such a conventional flat speaker is shown. FIG. 14 is a plan view, partly broken away, of a known cell phone. FIG. 15 is a partial sectional view taken on the line XV-XV in FIG. 14. FIG. 16 is a wave graph showing the sound characteristic of the flat speaker shown in FIG. 14.

In FIGS. 14 and 15, the reference numeral 20 denotes a cell phone with a display assembly. The cell phone 20 has a casing 21, a printed circuit board 22 and a display screen 23, such as a liquid crystal display, secured to the printed circuit board 22. Although not shown, the display screen 23 includes a holder for securing a back light, the liquid crystal display and other elements to the printed circuit board 22. A vibratory sound panel 2 is mounted on a window frame 21*a* of the casing 21 and protects the surface of the display screen 23. The vibratory sound panel 2 includes a transparent display region 2*a* and an exciter mount region 2*b*. A printed layer 2*c* is attached to the outer periphery of the display region 2*a* and the exciter mount region 2*b*. A space 8 is defined between the display region 2*a* and the display screen 23. An exciter 3 is mounted to the inner surface of the exciter mount region 2*b* and adapted to cause the vibratory sound panel 2 to vibrate in response to an electric or acoustic signal. A suspension 4 is in the form of a frame and supports the vibratory sound panel 2 on the upper surface of the window frame 21*a*. The suspension 4 is made of a cushioning material, such as sponge, with an adhesive applied to its opposite sides (for example, "Poron L32" sold by Nitto Kagaku Kogyo K.K.). The suspension may alternatively be in the form of a double-sided adhesive or a similar adhesive. The suspension 4 has a function to flexibly hold the vibratory sound panel 2 and dampen vibrations of the vibratory sound panel.

Referring to FIG. 15, a flat speaker 1 is composed of the vibratory sound panel 2, the exciter 3 and the suspension 4. A seal 6 is in the form of a frame and is made of a cushioning material such as sponge. The seal 6 is sandwiched between the inner surface of the window frame 21*a* and the display screen 23 and extends around the top edge of the display screen 23. The flat speaker 1 is supported on the casing 21 solely by the suspension which extends around the peripheral edge of the sound panel 2. This arrangement enables the vibratory sound panel 2 to be readily vibrated by the exciter 3. The vibratory sound panel 2 is thus capable of producing sound with a wide range of frequencies and a high level of sound pressure. In FIG. 16, the sound characteristic denoted by an indication "speaker" is determined by first inputting a large input signal to the exciter and then, measuring the sound pressure and the frequency of sound at a point separated from the flat speaker by 10 cm. The sound characteristic denoted by an indication "receiver" is determined by first inputting a small input signal to the exciter and then, measuring the sound pressure and the frequency of sound as if the ear of a user is placed in close contact with the vibratory sound panel.

The known flat speaker 1 has a space 8 above the display screen 23 and a space 9 adjacent the exciter 3. The space 8 is communicated with the space 9. If dust is attached to the exciter 3 and its surrounding parts, such dust may possibly enter the space 8. As the display surface of the display screen 23 is visible through the display window of the casing 21 and the space 8, dust, if introduced into the space 8, deteriorates the esthetic appearance of the display screen. To this end, attempts have been made to isolate the space 8 from the space 9, as shown in FIG. 17. Specifically, the display screen 23 is located inside the window frame 21*a*. The seal 6 is sandwiched between the display screen 23 and the sound panel 2. The seal 6 serves as a dust seal to isolate the space 8 from the space 9. The seal 6 is substantially identical in thickness to the suspension. However, such an arrangement prevents free vibration of the vibratory sound panel 2 and also, deteriorates the sound characteristic of the flat speaker due to a lack of sound pressure, as shown in FIG. 18.

It is, therefore, an object of the present invention to provide an acoustic device and a flat speaker which can improve the esthetic appearance of a display screen without losing its sound characteristic.

SUMMARY OF THE INVENTION

According to one aspect of the present invention, there is provided a flat speaker for use in an acoustic device including a casing having a display window, and a display assembly having a display screen mounted within the casing and visible through the display window, wherein the flat speaker comprises a vibratory sound panel adapted to be mounted to the display window and having a display region through which the display screen is visible and an exciter mount region, an exciter mounted to the inner surface of the exciter mount region and operated to cause the vibratory sound panel to vibrate in response to an electric signal, and a dust barrier member disposed between said display region and said exciter mount region and extending across said vibratory sound panel so that, when said flat speaker is assembled with said acoustic device, said dust barrier member inhibits dust particles from moving from said exciter mount region to said display region within said casing, said dust barrier member being yieldingly deformable in response to vibration of said vibratory sound panel.

In this flat speaker, the dust barrier member prevents dust particles from moving from the exciter mount region to the display region and thus the surface of the display screen is kept clean. Advantageously, the dust barrier member is so yieldingly deformable as to allow vibration of the vibratory sound panel to a greater extent. The flat speaker is thus capable of providing high quality sound.

In a preferred embodiment, the dust barrier member has one end attached to the vibratory sound panel and the other end adapted to be sealingly attached to the display assembly when the flat speaker is assembled with the acoustic device.

The display assembly includes, among others, the display screen such as a liquid crystal display, a back light, and a holder for retaining the display screen within the casing. The dust barrier member is sealingly connected to the surface of the display screen or the holder.

In one embodiment, the dust barrier member is adapted to be curvilinearly bent between the vibratory sound panel and the display assembly when the flat speaker is assembled with the acoustic device. This configuration of the dust barrier member facilitates deformation thereof in response to vibration of the vibratory sound panel.

In another embodiment, the one end and other end of the dust barrier member is arranged so that a line extending between the one end and the other end is angled to a line extending at right angles to the vibratory sound panel and the display screen. This configuration also allows the dust barrier to be yieldingly deformed or flexed in response to vibration of the vibratory sound panel.

In one embodiment, the dust barrier member extends at right angle to the vibratory sound panel and adapted to extend between and at right angle to the vibratory sound panel and the display screen when the flat speaker is assembled with the acoustic device, the dust barrier member having a height corresponding to the distance between the vibratory sound panel and the display assembly and a thickness, the height of the dust barrier member being at least one and half times greater than the width of the dust barrier member. This configuration enables the dust barrier member to be yieldingly deformed in response to vibration of the vibratory sound panel.

In another embodiment, the flat speaker further includes a suspension adapted to be disposed between a frame of the display window and the peripheral edge of the vibratory sound panel to support the vibratory sound panel on the frame when the flat speaker is assembled with the acoustic device. The dust barrier member extends across the suspension and may have opposite ends integrally formed with the suspension.

In still another embodiment, the display screen is rectangular and has first and second end edges and parallel side edges extending between the first and second end edge portions, the first end edge being remote from the exciter mount region, the second end edge being adjacent the exciter mount region. The dust barrier comprises a rectangular seal to be disposed between the vibratory sound panel and the display screen and having a first end edge portion extending along the first end edge of the display screen, parallel side edge portions extending from opposite ends of the first end edge portion toward the second end edge of the screen display and having tip ends extending beyond the second end edge of the display screen, and a second end edge portion extending between the tip ends. The dust barrier member extends between the second end edge portion of the rectangular seal and the second end edge of the display screen.

Preferably, the dust barrier member is in the form of a thin plate and is made of rubber or resin.

According to the other aspect of the present invention, there is provided an acoustic device including a casing having a display window, a display assembly having a display screen mounted within the casing and visible through the display window and a flat speaker configured as described above.

ADVANTAGES OF THE INVENTION

As stated above, the present invention is capable of preventing entry of dust into the space between the vibratory sound panel and the display screen without any adverse effect on the sound characteristic or quality of the flat speaker.

PREFERRED EMBODIMENTS

Figure 1:
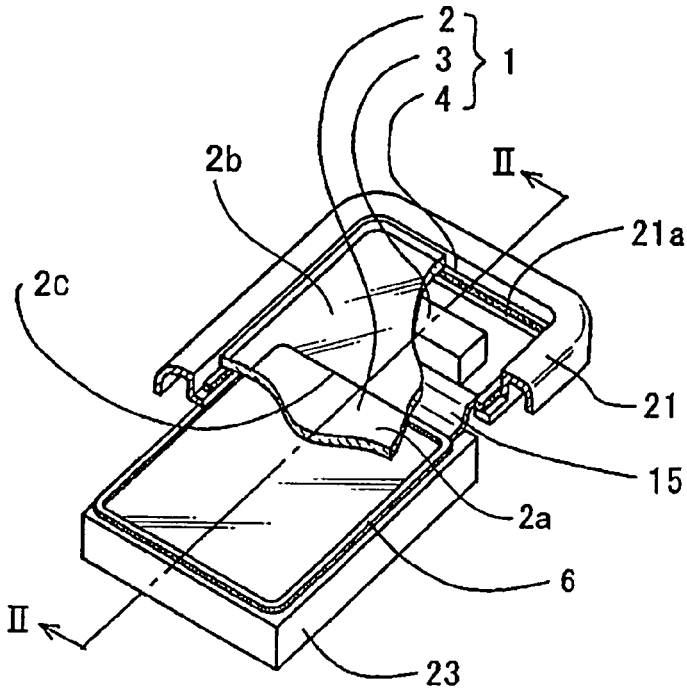
FIG. 1 is a perspective view, partly broken away, of a cell phone with a flat speaker according to a first embodiment of the present invention.
Figure 2:
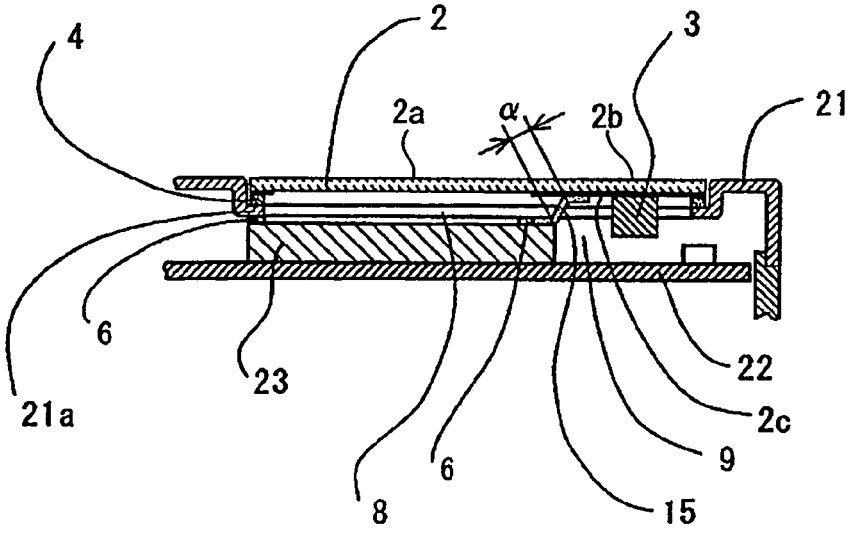
FIG. 2 is a sectional view taken on the line II-II in FIG. 1.

The present invention will now be described with reference to the accompanying drawings. FIG. 1 is a perspective view, partly broken away, of a cell phone with a flat speaker according to a first embodiment of the present invention. FIG. 2 is a partial sectional view taken on the line II-II in FIG. 1.

Referring to FIGS. 1 and 2, a flat speaker 1 generally includes a vibratory sound panel 2, an exciter 3 and a suspension 4. The reference numeral 15 denotes a dust membrane made of sponge, rubber, resin and other flexible materials (for example, "Poron L24" sold by Nitto Kako K.K.).

The dust membrane 15 has a substantially S-shaped section and extends across the vibratory sound panel 2. The sound panel 2 has a display region 2*a* and an exciter mount region 2*b* adjacent to the display region 2*a*. The upper edge of the dust membrane 15 is adhesively attached to the area of the sound panel 2 between the display region 2*a* and the exciter mount region 2*b*. The lower edge of the dust membrane 15 is located below the suspension 4 and is adhesively attached to a display screen 23 such as a liquid crystal display and an electro luminescent display. The dust membrane 15 has a region α between its upper and lower edges. No part of the region α is attached to the sound panel 2 or the display screen 23. The configuration of the dust membrane 15 will facilitate free vibration of the vibratory sound panel 2. A space 8 defined above the display screen 23 is sealingly closed by the sound panel 2, a display window frame 21*a*, the suspension 4, a seal 6 and the dust membrane 15 and is isolated from its surrounding space including a space 9 adjacent to the exciter 3. The lower edge of the dust membrane 15 is preferably placed in contact with one side of the seal 6 adjacent to the exciter 3. The other parts of the flat speaker are similar to those of the prior art flat speaker. Like parts are thus given like reference numerals and will not be described herein.

Figure 3:
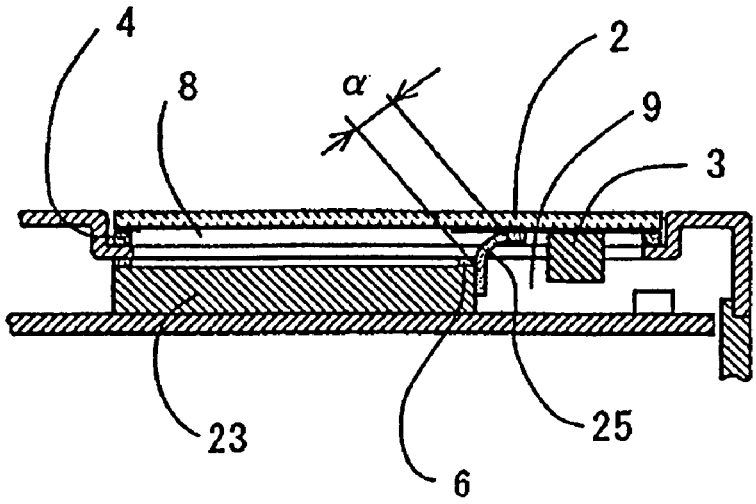
FIG. 3 is a sectional view, partly broken away, of a cell phone according to a second embodiment of the present invention.

Reference will next be made to a flat speaker according to a second embodiment of the present invention. FIG. 3 is a sectional view, partly broken away, of the flat speaker. As shown in FIG. 3, a dust membrane 25 has an upper edge secured to the lower surface of the sound panel 2 and a lower edge secured to one lateral side of the display screen 23. Preferably, the seal 6 is contacted with the dust membrane 25 without any clearance left therebetween. The space 8 is sealingly closed by the display screen 23, the sound panel 2, the display window frame 21*a*, the suspension 4, the seal 6 and the dust membrane 25 and is isolated from its surrounding space.

Figure 4:
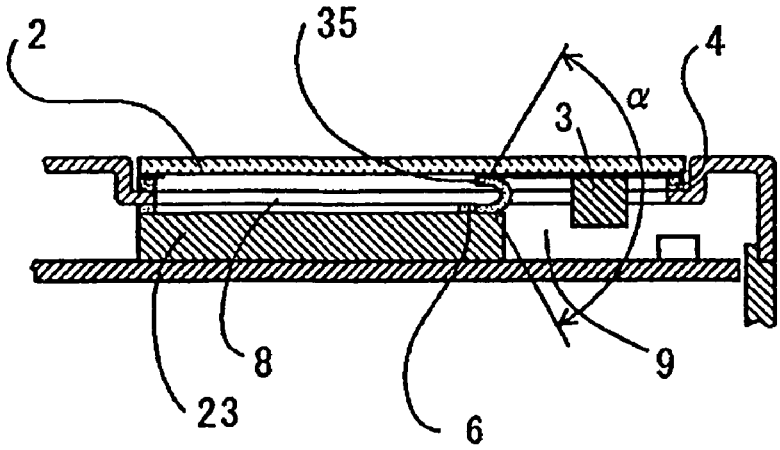
FIG. 4 is a sectional view, partly broken away, of a cell phone with a flat speaker according to a third embodiment of the present invention.

Reference will be made to a flat speaker according to a third embodiment of the present invention. FIG. 4 is a sectional view, partly broken away, of the flat speaker. As shown in FIG. 4, a dust membrane 35 has a substantially U-shaped section. The seal 6 extends along the peripheral edge of the display screen 23 and has a rectangular shape. The dust membrane 35 is placed in contact with one side of the seal 6 adjacent to the exciter 3 and secured to the upper surface of the display screen 23. The space 8 is sealingly closed by the display screen 23, the sound panel 2, the display window frame 21*a*, the suspension 4, the seal 6 and the dust membrane 35 and is isolated from its surrounding space.

Figure 5:
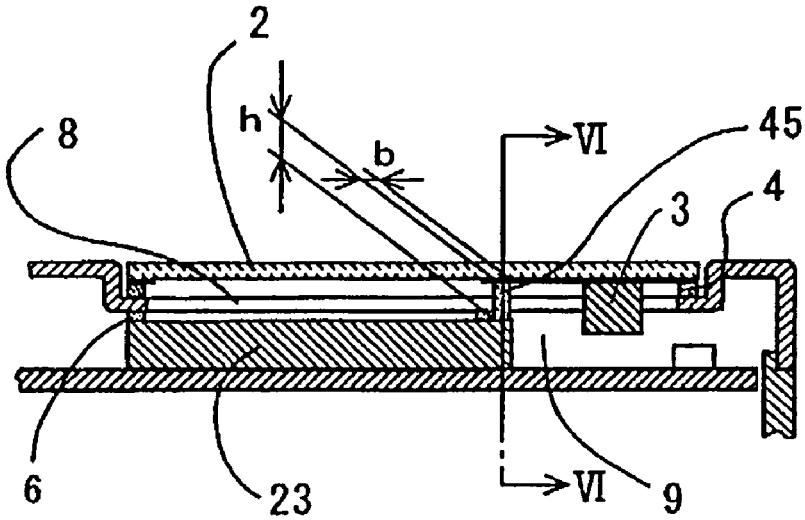
FIG. 5 is a sectional view, partly broken away, of a cell phone with a flat speaker according to a fourth embodiment of the present invention.
Figure 6:
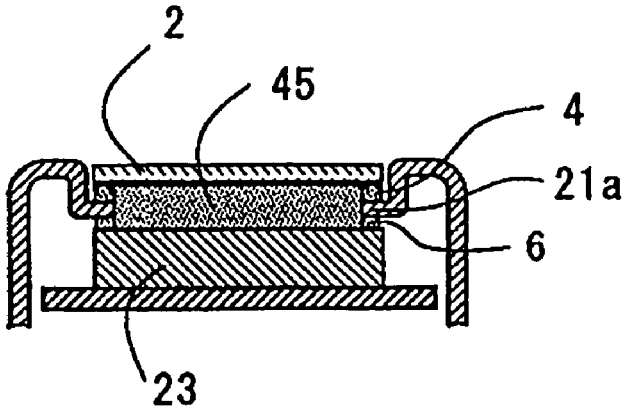
FIG. 6 is a sectional view taken on the line VI-VI in FIG. 5.

Reference will be made to a flat speaker according to a fourth embodiment of the present invention. FIG. 5 is a sectional view, partly broken away, of the flat speaker. FIG. 6 is a sectional view taken on the line VI-VI in FIG. 5. As shown in FIGS. 5 and 6, a dust membrane 45 vertically extends between the sound panel 2 and the display screen 23 and has a substantially I-shaped section. The dust membrane 45 has a width b and a height h. The ratio between the width b and the height h is preferably at least 1:1.5. Preferably, the dust membrane 45 is contacted with one side of the seal 6 without any clearance left between. The space 8 is sealingly closed by the display screen 23, the sound panel 2, the display window frame 21*a*, the suspension 4, the seal 6 and the dust membrane 45 and is isolated from its surrounding space.

Figure 7:
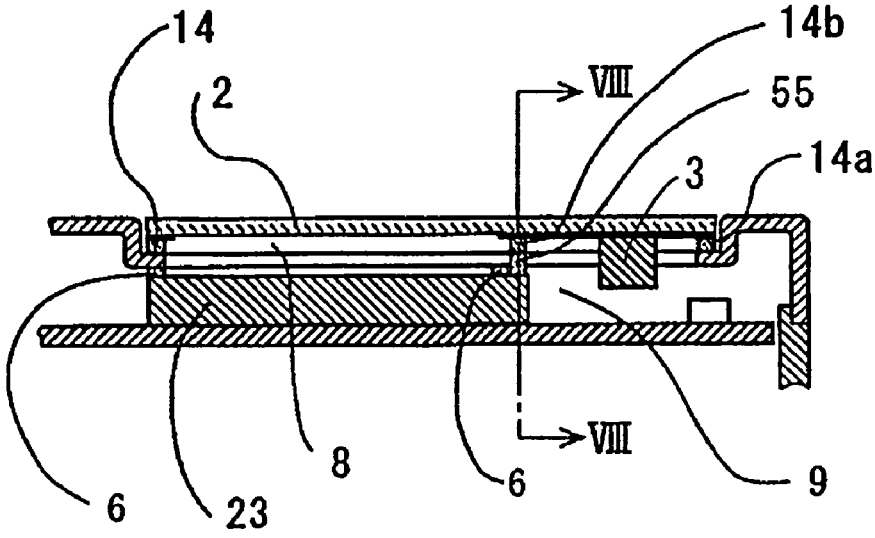
FIG. 7 is a sectional view, partly broken away, of a cell phone with a flat speaker according to a fifth embodiment of the present invention.
Figure 8:
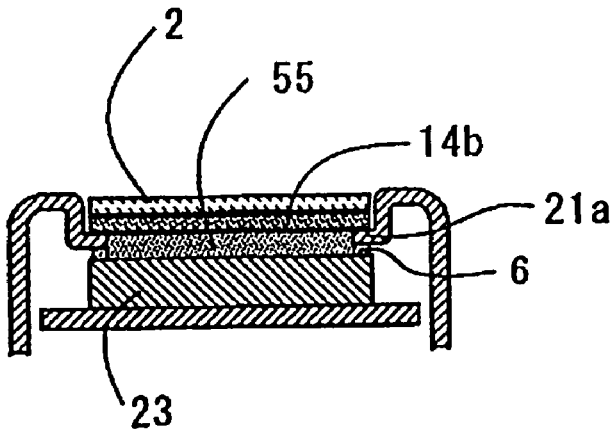
FIG. 8 is a sectional view taken on the line VIII-VIII in FIG. 7.

Reference will now be made to a flat speaker according to a fifth embodiment of the present invention. FIG. 7 is a sectional view, partly broken away, of the flat speaker. FIG. 8 is a sectional view taken on the line VIII-VIII in FIG. 7. As shown in FIGS. 7 and 8, a suspension 14 is made of a material similar to that of which the suspension 4 is made. The suspension 14 has a rectangular outer peripheral portion 14*a* and a bridge portion 14*b* extending across the outer peripheral portion 14*a* and integrally formed therewith. In this embodiment, a member 55 vertically extends between the bridge portion 14*b* and the display screen 23 and has a substantially I-shaped section. The member 55 and the bridge portion 14*b* collectively form a dust membrane which is similar in function to those dust membranes described above. The space 8 is sealingly closed by the display screen 23, the sound panel 2, the display window frame 21*a*, the suspension 14, the seal 6 and the dust membrane 14*b*, 55 and is isolated from its surrounding space.

All the membranes 15, 25, 35, 45 and 55 are made of a like material although the membranes are different from one another in shape. Also, all the membranes 15, 25, 35, 45 and 55 extend below the suspension 4. In an alternative embodiment, the seal may have a cutout portion, and the dust membrane may have a portion extending into the cutout portion of the seal. Still alternatively, a dust membrane and a seal may be integrally formed together.

Figure 9:
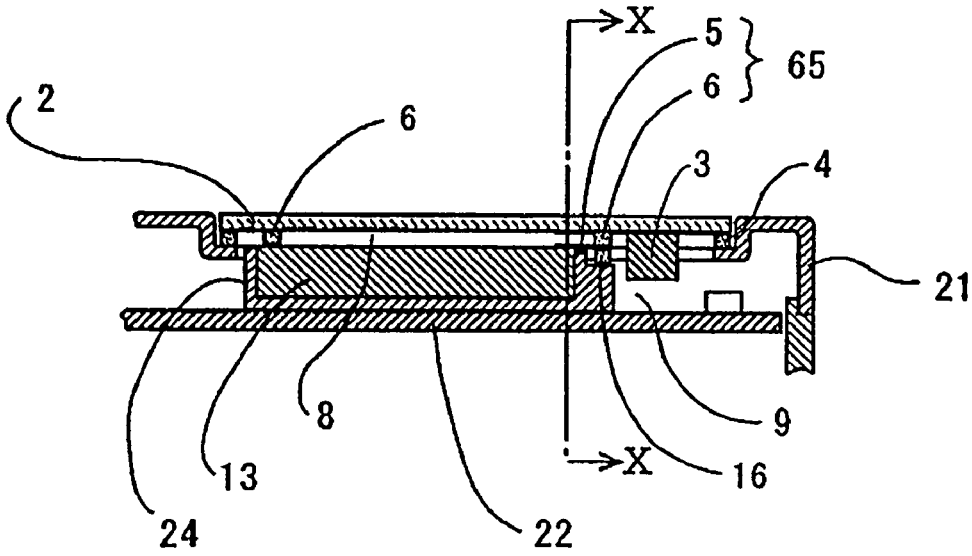
FIG. 9 is a sectional view, partly broken away, of a cell phone with a flat speaker according to a sixth embodiment of the present invention.
Figure 10:
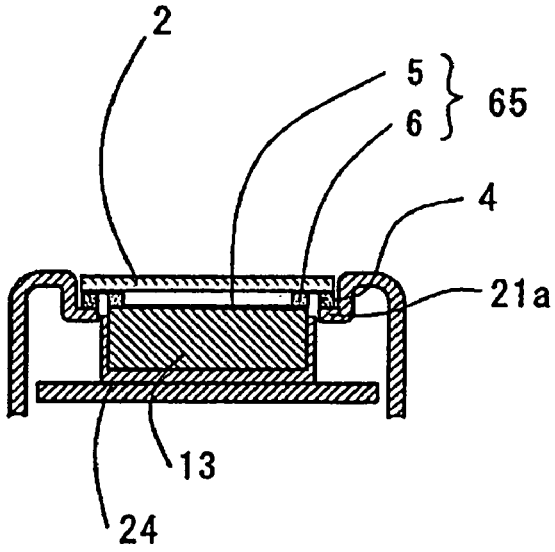
FIG. 10 is a sectional view taken on the line X-X in FIG. 9.
Figure 11:
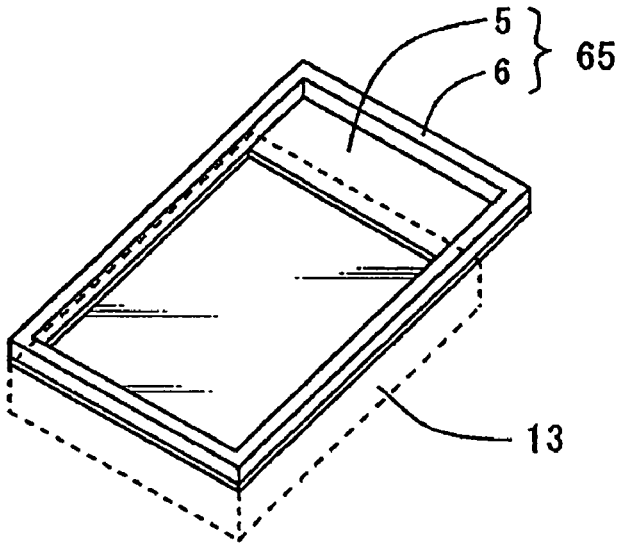
FIG. 11 is a perspective view of a dust burrier shown in FIG. 9.

Reference will next be made to a flat speaker according to a sixth embodiment of the present invention. FIG. 9 is a sectional view, partly broken away, of the flat speaker. FIG. 10 is a sectional view taken on the line X-X in FIG. 9. FIG. 11 is a perspective view of a dust membrane of the flat speaker. As shown in FIGS. 9 and 10, the reference numeral 13 denotes a liquid crystal display with a back light. The reference numeral 24 denotes a holder made of plastic. The holder 24 is adapted to hold the liquid crystal display 13 and secure the liquid crystal display 13 to a printed circuit board 22. As shown in FIG. 11, the rectangular seal 6 has one side secured to the upper surface of the liquid crystal display 13 and the other side engaged with the sound panel 2. The seal 6 has an overhang which extends from the liquid crystal display 13 toward the exciter 3. A film 5 is placed on the bottom of the overhang of the seal 6. The film 5 is made of the same material as the dust membrane 15. The film 5 and the seal 6 are adhered together and collectively form a dust membrane 65. As an alternative, the film 5 and the seal 6 may be integrally molded together. An auxiliary seal 16 is placed on the holder 24 (or the printed circuit board 22) to support the overhang of the seal 6. The space 8 is sealingly closed by the seal 6 and the liquid crystal display 13, the sound panel 2 and the dust membrane 65 and is isolated from the space 9.

Figure 12:
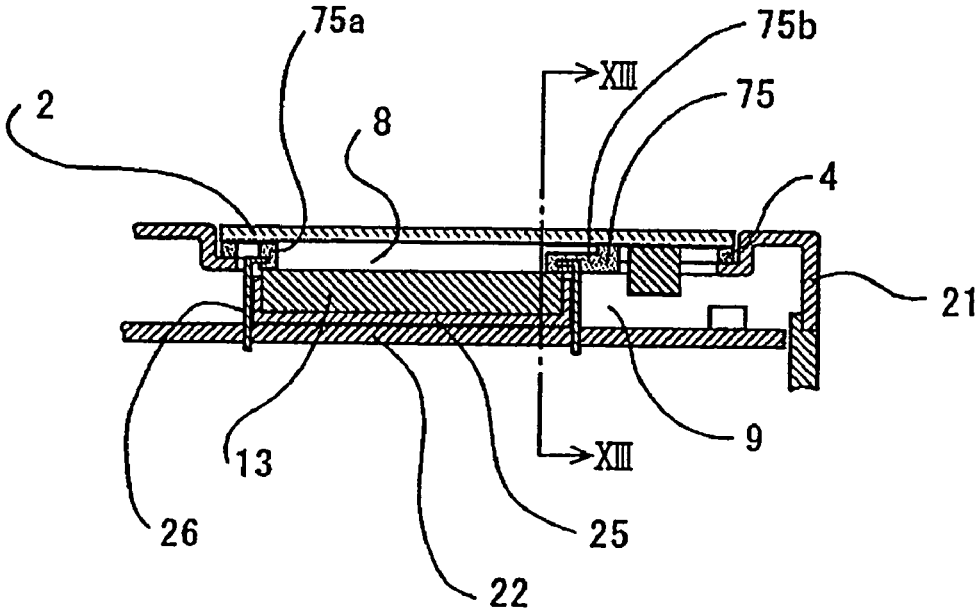
FIG. 12 is a sectional view, partly broken away, of a cell phone with a flat speaker according to a seventh embodiment of the present invention.
Figure 13:
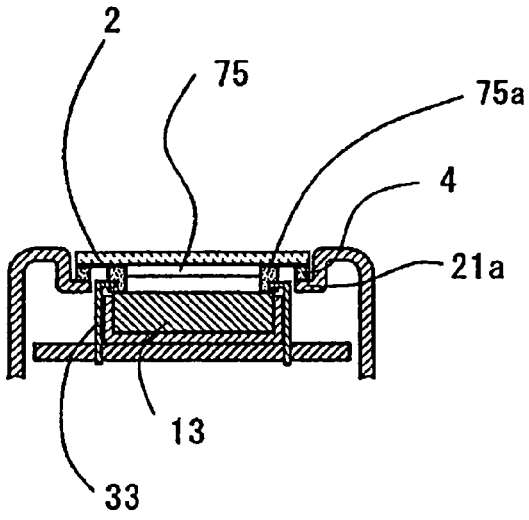
FIG. 13 is a sectional view taken on the line XIII-XIII in FIG. 12.
Figure 14:
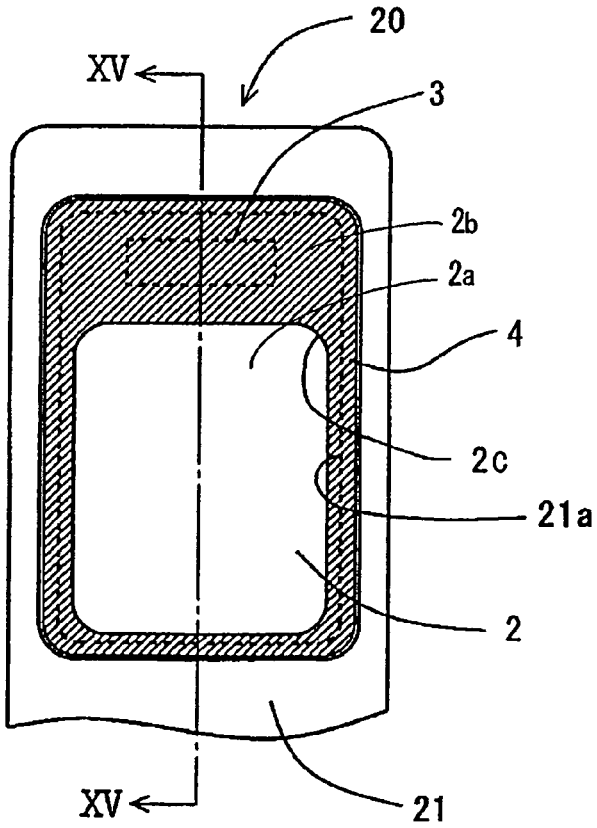
FIG. 14 Prior Art
FIG. 14 is a plan view of a cell phone with a known flat speaker.
Figure 15:
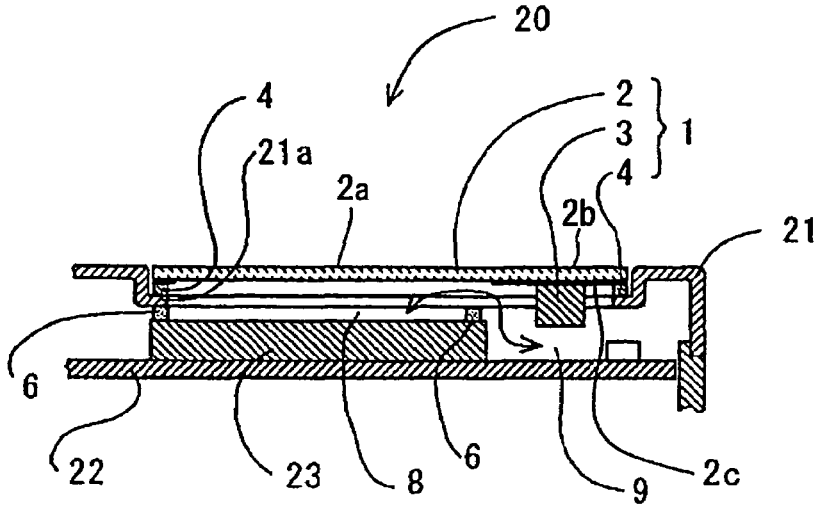
FIG. 15 Prior Art
FIG. 15 is a sectional view taken on the line XV-XV in FIG. 14.
Figure 16:
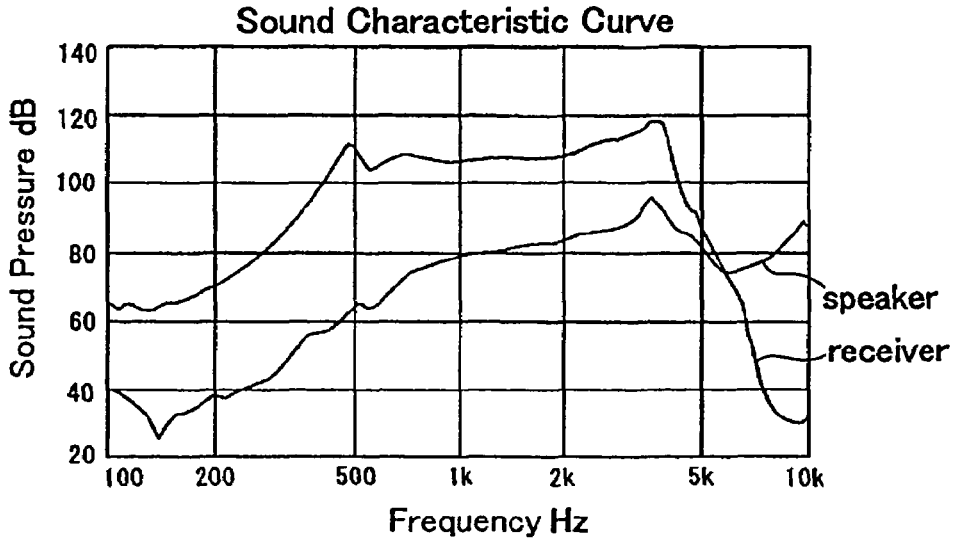
FIG. 16 Prior Art
FIG. 16 is a wave graph showing the sound characteristic of the known flat speaker.
Figure 17:
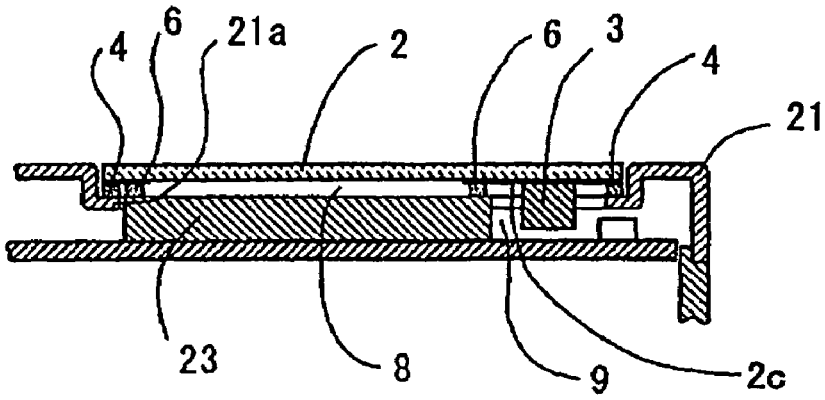
FIG. 17 is a sectional view, partly broken away, of a cell phone with another known flat speaker.
Figure 18:
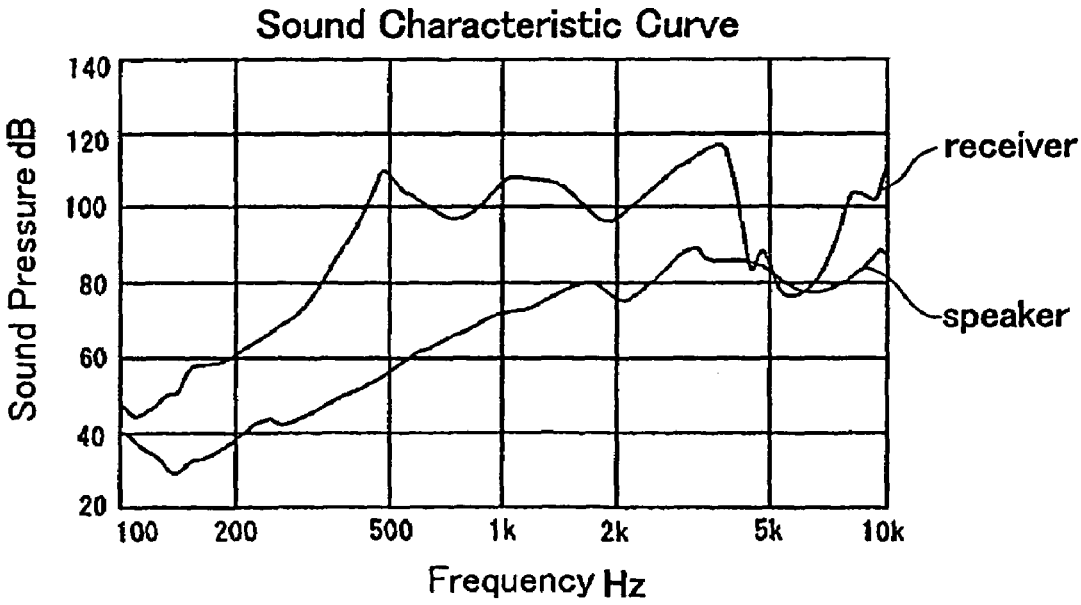
FIG. 18 is a wave graph showing the sound characteristic of the known flat speaker shown in FIG. 17.

Reference will be made to a flat speaker according to a seventh embodiment of the present invention. FIG. 12 is a sectional view, partly broken away, of the flat speaker. FIG. 13 is a sectional view taken on the line XIII-XIII in FIG. 12. In FIGS. 12 and 13, the reference numeral 25 denotes a display case made of plastic and adapted to hold the liquid crystal display 13. A holder 26 is made of a sheet metal and extends around the display case 25. The holder 26 is adapted to secure the liquid crystal display 13 to the printed circuit board 22. The reference numeral 75 denotes a dust membrane injection molded to the holder 26. The dust membrane 75 has a generally rectangular shape. The dust membrane 75 includes a seal section 75*a* and a thin section 75*b*. Like the overhang of the seal 6 shown in FIGS. 9 and 11, the seal section 75*a* has an overhang which extends from the liquid crystal display 13 toward the exciter. Like the film 5 shown in FIGS. 9 and 11, the thin section 75*b* is integrally formed with the seal section 75*a*. The space 8 is sealingly closed by the liquid crystal display 13, the sound panel 2 and the dust membrane 75 and is isolated from the space 9.

Reference will now be made to the operation of the first to third embodiments of the present invention (see FIGS. 1 to 4). As described earlier, no part of the region α of each of the dust membranes 15, 25, 35 is attached to the sound panel 2 and the display screen 23. The region α provides a flexible connection between the sound panel 2 and the display screen 23. Such a flexible connection facilitates free vibration of the vibratory sound panel 2 and has little acoustically adverse effect on the function of the flat speaker.

Reference will next be made to the operation of the fourth and fifth embodiments of the present invention (FIGS. 5 to 8). As describer earlier, the dust membranes 45, 55 vertically extend between the sound panel 2 and the display screen 23. The distance between the sound panel 2 and the display screen 23 is equal to the total thickness of the suspension 4, 14, the display window frame 21*a* and the seal 6. In other words, the distance between the sound panel 2 and the display screen 23 is greater than the thickness of the suspension 4, 14 alone. As such, the use of the vertical dust membranes does not affect vibration of the sound panel 2. It has been found that the sound panel is substantially free to vibrate if the height h of the dust membrane 45 is at least one and half times greater than the width b of the dust membrane 45.

Reference will be made to the operation of the sixth and seventh embodiments of the present invention (FIGS. 9 to 12). As described earlier, the overhangs of the rectangular seals 6 and the seal section 75*a* extend from the liquid crystal display 13 toward the exciter 3. By this arrangement, the overhangs are free from compression between the sound panel 2 and the liquid crystal display 13 and, thus, the dust membranes 65, 75 do not affect free vibration of the sound panel 2. Particularly, in the sixth embodiment, the auxiliary seal 16 supports the frame of the dust membrane 65 and thus, improves sealing integrity between the dust membrane 65 and the sound panel 2.

According to the present invention, the dust membrane isolates the space 8 from the space 9 and prevents entry of dust from the space 9 into the space 8. Additionally, the dust membrane does not affect free vibration of the sound panel 2 and thus, aids to enhance sound quality of an acoustic device such as a cell phone in which the flat speaker is installed.

The present invention is not limited to portable devices such as a cell phone and a PDA, but is equally applicable to a wide variety of acoustic devices.

What is claimed is:

1. An acoustic device comprising:

a casing including a window frame in which a display window is defined;

a vibratory sound panel including a display region and an exciter mount region adjacent to the display region, the vibratory sound panel having a peripheral edge;

a suspension disposed between the display frame and the peripheral edge of the vibratory sound panel to support the vibratory sound panel on the window frame of the casing;

a display assembly mounted within the casing adjacent to the display region and including a display screen visible through the display region, the casing having a first space defined between the display screen and the vibratory sound panel and having a second space surrounding the first space;

an exciter mounted to the exciter mount region and located within the casing, the exciter being operated to cause the vibratory sound panel to vibrate in response to an electric signal; and a dust barrier for isolating the first space from the second space to prevent entry of dust from the second space into the first space, the dust barrier including a dust barrier member disposed between the display region and the exciter mount region and extending across the vibratory sound panel to inhibit dust particles from moving from the exciter mount region to the display region within the casing, the dust barrier member being yieldingly deformable in response to vibration of the vibratory sound panel;

the dust barrier member sealingly engaged with the vibratory sound panel and the display screen, the dust barrier member having a first end engaged with the vibratory sound panel and having a second end engaged with the display screen, and the first end and the second end of the dust barrier member being disposed so that a line connecting the first and second ends of the dust barrier member is angled to an imaginary line that extends at right angles to the vibratory sound panel and the display screen.

2. The acoustic device according to claim 1, wherein the dust barrier member curvilinearly extends between the vibratory sound panel and the display screen.

3. The acoustic device according to claim 1, wherein the dust barrier member extends to the vibratory sound panel and the display screen, the dust barrier member having a height corresponding to the distance between the vibratory sound panel and the display assembly and having a thickness, the height of the dust barrier member being at least one and half times greater than the thickness of the dust barrier member.

4. The acoustic device according to claim 1, wherein the dust barrier member has opposite ends integrally formed with the suspension.

5. The acoustic device according to claim 1, wherein the display screen is rectangular and has first and second end edges and parallel side edges extending between the first and second end edge portions, the first end edge being remote from the exciter mount region, the second end edge being adjacent to the exciter mount region;

the dust barrier further comprises a rectangular-frame seal disposed between the vibratory sound panel and the display screen and having a first end edge portion extending parallel with the first end edge of the display screen, a second end edge portion extending parallel with the second end edge of the display screen, and parallel side edge portions extending parallel with the parallel side edges of the display screen.

6. The acoustic device according to claim 1, wherein the dust barrier member is in the form of an elongated thin plate and is made of rubber or resin.

7. The acoustic device according to claim 1, wherein the dust barrier member of the dust barrier has a substantially S-shaped section.

8. The acoustic device according to claim 1, wherein the dust barrier member of the dust barrier has a substantially U-shaped section.

9. A flat speaker configured to be disposed in an acoustic device, the acoustic device including a casing having a display window, and a display assembly having a display screen mounted within the casing and visible through the display window, the flat speaker comprising:

a vibratory sound panel configured to be mounted at the display window and having a display region through which the display screen is visible and an exciter mount region adjacent to the display region, the exciter mount region having an inner surface and an outer surface;

an exciter mounted to the inner surface of the exciter mount region and operated to cause the vibratory sound panel to vibrate in response to an electric signal; and a dust barrier comprises a rectangular-frame seal disposed under the vibratory sound panel to surround the display screen and comprising an elongated portion extending across the vibratory sound panel and configured to be disposed between the display screen and the exciter, the elongated portion having one end attached to the vibratory sound panel and other end to be engaged with the display screen to inhibit dust particles from moving from the exciter mount region to the display region within the casing when the flat speaker is assembled with the acoustic device, the elongated portion being yieldingly deformable in response to vibration of the vibratory sound panel;

wherein the one end and the other end of the elongated portion is arranged so that a line connecting the one end and the other end is angled to an imaginary line extending at right angles to the vibratory sound panel and the display screen.

10. The flat speaker according to claim 9, wherein the dust barrier member is configured to be curvilinearly bent between the vibratory sound panel and the display assembly when the flat speaker is assembled with the acoustic device.

11. The flat speaker according to claim 9, wherein the dust barrier member extends to the vibratory sound panel and is configured to extend between the vibratory sound panel and the display screen when the flat speaker is assembled with the acoustic device, the dust barrier member having a height corresponding to the distance between the vibratory sound panel and the display assembly and having a thickness, the height of the dust barrier member being at least one and half times greater than the thickness of the dust barrier member.

12. The flat speaker according to claim 9, wherein the flat speaker further comprises a suspension configured to be disposed between a frame of the display window and the peripheral edge of the vibratory sound panel to support the vibratory sound panel on the frame when the flat speaker is assembled with the acoustic device; and, the dust barrier member extends across the suspension and has opposite ends integrally formed with the suspension.

13. The flat speaker according to claim 9, wherein the display screen is rectangular and has first and second end edges and parallel side edges extending between the first and second end edge portions, the first end edge being remote from the exciter mount region, the second end edge being adjacent to the exciter mount region; and the one end of the elongated portion is attached to the vibratory sound panel and the other end of the elongated portion is engaged with the second end edge of the display panel.

14. The flat speaker according to claim 13, wherein the elongated portion of the dust barrier has a substantially S-shaped section.

15. The flat speaker according to claim 13, wherein the elongated portion of the dust barrier has a substantially U-shaped section.

16. The flat speaker according to claim 9, wherein the dust barrier member is in the form of an elongated thin plate and is made of rubber or resin.

* * * * *